United States Patent [19]

Frederick

[11] Patent Number: 5,070,801

[45] Date of Patent: Dec. 10, 1991

[54] METHOD AND APPARATUS FOR IMPEDING THE SPILLAGE OF A LIQUID CARGO FROM A DAMAGED WATER-TRAVELING VESSEL

[75] Inventor: Carl R. Frederick, Plainfield, N.J.

[73] Assignee: Environmental Innovations, Inc., New York, N.Y.

[21] Appl. No.: 548,082

[22] Filed: Jul. 5, 1990

Related U.S. Application Data

[63] Continuation-in-part of Ser. No. 359,952, Jun. 1, 1989, Pat. No. 4,982,678.

[51] Int. Cl.[5] ..... B63B 25/12

[52] U.S. Cl. ..... 114/74 R; 220/403; 383/119; 428/116

[58] Field of Search ..... 114/74 R, 74 A, 74 T, 114/69, 227, 256, 257; 210/168, 507, 242.4; 220/9.2, 403, 404, 426, 445, 448; 383/109, 113, 116, 117, 119; 428/36.1, 36.2, 116, 259; 405/62, 63, 64

[56] References Cited

U.S. PATENT DOCUMENTS

| | | | |
|---|---|---|---|
| 2,991,906 | 7/1961 | Eligoulachvili | 220/63 |
| 2,994,452 | 8/1961 | Morrison | 220/9 |
| 3,085,027 | 4/1963 | Porteous | 383/119 |
| 3,167,103 | 1/1965 | Hawthorne et al. | 114/74 T |
| 3,272,373 | 9/1966 | Alleaume et al. | 220/9 |
| 3,699,912 | 10/1972 | Wilson, Jr. | 114/74 R |
| 3,735,721 | 5/1973 | Leguijt | 114/74 T |
| 3,827,136 | 8/1974 | Yamamoto | 29/455 |
| 3,844,239 | 10/1974 | McLaughlin et al. | 114/74 R |
| 3,882,591 | 5/1975 | Yamamoto | 29/455 |
| 3,906,880 | 9/1975 | Herbert | 114/74 R |
| 3,931,424 | 1/1976 | Helf et al. | 428/33 |
| 3,952,679 | 4/1976 | Grihangne | 114/74 T |
| 4,227,477 | 10/1980 | Preus | 114/256 |
| 4,230,061 | 10/1980 | Roberts et al. | 114/74 A |
| 4,264,443 | 4/1981 | Anderson et al. | 210/168 |
| 4,301,961 | 11/1981 | Rodish | 383/119 |
| 4,347,798 | 9/1982 | Gallagher | 114/74 R |
| 4,359,501 | 11/1982 | DiTullio | 428/259 X |
| 4,373,462 | 2/1983 | Fish | 114/74 R |
| 4,484,533 | 11/1984 | David | 114/74 R |

*Primary Examiner*—Sherman Basinger

*Attorney, Agent, or Firm*—R. Neil Sudol; Henry D. Coleman

[57] ABSTRACT

A device for impeding the flow of liquid cargo from a storage compartment of a water-traveling vessel upon damage to a hull of the vessel the device comprises a barrier member including (a) an upper portion of a flexible sheet material resistant to the liquid cargo and substantially impermeable thereto and (b) a lower portion attached to the upper portion and including a web of fabric material resistant to the liquid cargo and having a predetermined limited degree of permeability thereto. The flow impedance device further comprises reinforcement elements attached to the web for strengthening the fabric material and for at least inhibiting a tear from spreading in the web more than a predetermined distance from a point of perforation of the web. The flow impedance device also comprises bendable elongate resilient support members for supporting the barrier member inside the storage compartment of the water-traveling vessel. The web of fabric material is releasably attached to a panel of the barrier member via connector elements, facilitating replacement and maintenance of the permeable fabric web. The fabric web is made in part of threads of a hydrophilic composition, which act in a microscopic valve actin to render the fabric less permeable upon contact with water.

43 Claims, 7 Drawing Sheets

METHOD AND APPARATUS FOR IMPEDING THE SPILLAGE OF A LIQUID CARGO FROM A DAMAGED WATER-TRAVELING VESSEL

CROSS-REFERENCE TO A RELATED APPLICATION

This application is a continuation-in-part of U.S. patent application Ser. No. 359,952 filed June 1, 1989, now U.S. Pat. No. 4,982,678.

BACKGROUND OF THE INVENTION

This invention relates to a device, apparatus or assembly for impeding the flow of liquid cargo such as petroleum from a storage compartment of a water-traveling vessel such as a tanker upon damage to a hull of the tanker. This invention also relates to a method for minimizing spillage of the liquid cargo into the environment from a damaged compartment of a water-traveling vessel.

Bulk liquid cargo such as petroleum is generally transported in sea-going vessels such as freighters or tankers having a single walled hull defining a hold. Even though the hold of such a ship is usually subdivided into a plurality of storage compartments, those compartments are nevertheless so large that, should an accident occur and the hull of the vessel become perforated or fractured, a great quantity of petroleum or other liquid cargo is likely to spill into the environment. The great ecological damage resulting from such a spill has been brought to the public's attention through several well publicized incidents.

In the case of a shipwrecked or stranded ship, where the hull of the ship has been perforated and a storage compartment bearing liquid cargo is in communication with the sea, the waves act to pump oil from the storage compartment and, over the course of several hours, a large amount of the cargo may be spilled out onto the water.

One previously proposed solution to the problem of minimizing the potential damage due to oil spills is to use a double hull. Such a solution has at least two substantial drawbacks: cost and ineffectiveness. The cost of equipping new tankers with a double hull is obvious. Moreover, it would be practically impossible to retrofit existing tankers with a double hull at any reasonable cost.

A double hull may be ineffective in many situations because whatever can pierce or fracture a steel plate three-quarters of an inch thick could well be sufficiently forceful to pierce a second steel plate spaced a short distance inwardly from the outer hull wall.

An alternative solution to the double hull is the provision of a flexible liner inside each compartment of a petroleum carrying vessel. Such a solution is certainly less expensive than double hulls and can be used in retrofitting existing vessels.

Impermeable flexible liners or bladders are disclosed in U.S. Pat. No. 4,230,061 to Roberts et al. and U.S. Pat. No. 3,844,239 to McLaughlin et al. Roberts et al. more particularly discloses a petroleum bearing bladder of a woven polyester material coated with a liquid and gas impervious film in the form of a silicone rubber elastomer. Advantages of such a flexible inner liner include easy installation in existing vessels and easy removal to enable repairs on the inner side of the ship's hull. Disadvantages of the liner of Roberts et al. is that it does not conform to the inner wall of the hull and thus reduces the amount of payload. In addition, because the liner must continually support the liquid cargo, the liner is subject to considerable stresses during periods of normal, non-emergency use. Such continual stresses greatly weaken the fabric material and may result, in emergency situations, in failure which otherwise would not have occurred but for the fatigue stressing of the liner material.

McLaughlin et al. is directed to an ejection piping system in which each storage compartment of a tanker is connected via a conduit to an empty space. Each compartment is additionally lined with an impermeable, elastomeric tailored lining releasably fixed to the inner walls of the respective compartment. Upon a deformation of the walls of the storage compartment due to a collision, the liner is released and flexes inwardly to eject the liquid payload, e.g., crude oil, through the conduit to empty space.

The solution of McLaughlin et al. avoids the disadvantages of payload reduction and liner stressing, inasmuch as the liner is, in at least one specific embodiment, disposed in contact with the inner surface of the storage compartment, including the hull. In the event of a collision, the liner separates from the compartment surface. A disadvantage of such a system is that the liner, in being located against the hull, most probably will be torn, shredded or pierced by the same force which opens a hole in the side of the vessel.

The use of flexible liners to contain liquid bulk materials has also been proposed with respect to the transport of cold liquified gases. U.S. Pat. Nos. 3,883,591 and 3,827,136 to Yamamoto, U.S. Pat. No. 3,272,373 to Alleaume et al. and U.S. Pat. No. 2,994,452 to Morrison all relate to liquified gas storage tanks including a membranous lining. More particularly, both patents to Yamamoto show a low temperature liquified gas tank having an inner membrane provided inside a rigid outer vessel with the interposition of a heat insulating layer. The tank is constructed so that the liner conforms as much as possible to the outer vessel.

Alleaume et al. describes an impermeable inner membrane which contains a cold liquified substance and is in contact with a hull of a ship. The membrane takes the form of a large bag held at its neck at an opening in the top of a storage compartment in which the bag is placed. In Several embodiments disclosed in Alleaume et al., two bags are placed within a storage compartment, one bag inside the other, the bags being separated by pressurized gas or cellular material.

Morrison involves a storage facility including a cylindrical outer tank made of steel, an intermediate insulating layer of balsa wood and a inner bag or lining made of a woven glass fiber impregnated and coated with synthetic resin material. A plurality of flexible supporting straps or hangers suspends the bag from the roof of the steel tank.

In solving other problems, including that of transporting two different kinds of fluidic materials in the same storage compartment of a ship so that the materials do not mix or come into contact with one another, U.S. Pat. No. 4,347,798 to Gallagher discloses an expandable bag disposed at the bottom of a storage compartment. The expandable bag may be partially or completely filled with a buffer fluid to protect cargo in the storage compartment from a penetration through the bottom of the compartment. The expandable bag is made of a material which is impervious to liquid cargo contained in the storage compartment.

Another solution to minimizing the spillage of petroleum from a damaged tanker is to provide a floating flexible structure into which the petroleum may be pumped from one or more damaged compartments of the tanker. As disclosed in U.S. Pat. No. 4,373,462 to Fish, such a structure may then be towed away for disposal of the oil. Fish more specifically sets forth a towable tank comprising four elongate pieces fixed to each other by side seams and upper and lower seams to form a receptacle. In addition, clamps are applied to the pieces at the front and the rear of the assembly.

U.S. Pat. No. 4,227,477 to Preus also discloses an inflatable, flexible, towable container for receiving petroleum from a damaged vessel and transporting the petroleum to dockside or to another vessel. The inflatable container is provided along its sides and, in some embodiments, along its entire periphery with gas-inflatable buffer or bumper tubes for protecting the skin of the container from rupturing due to collisions with floating wreckage, jetties, etc.

Two other patents which disclose flexible floating tanks for conveying liquids are U.S. Pat. No. 3,952,679 to Grihange and U.S. Pat. No. 3,735,721 to Leguijt. A floating tank in accordance with the disclosure of Grihange comprises a pair of elongate tanks disposed side by side and joined to one another by a flexible linking harness. The tanks are internally divided by bulkheads and have oblique forward ends. The tanks' shapes are maintained by inflating gas.

Leguijt discloses an oil storage system comprising rectangular basin divided by partitions into a plurality of compartments each containing an envelope floating in water and in turn containing oil. The envelopes are rectangular when empty and made of impregnated nylon fabric.

Proposing another solution to the problem of confining oil in a tanker upon rupture of the hull of the tanker in an accident, U.S. Pat. No. 2,699,912 to Wilson, Jr. discloses an apparatus including a cup shaped inner barrier and an inverted outer barrier, both comprising panels made of form-sustaining but liquid-tight material sealingly secured to the walls of one or more compartments of a ship's hull. Should the hull be ruptured, the panels deform without rupturing and cooperate with each other to form a seal against the escape of the oil.

OBJECTS OF THE INVENTION

A primary object of the present invention is to provide a method and an associated apparatus or device, utilizable in water-traveling vessels and tankers carrying liquid cargo such as petroleum, for minimizing damage to the environment upon accidental damage to the hull of such a vessel or tanker.

A related object of the present invention is to provide an apparatus, assembly or device for impeding the flow of liquid cargo such as petroleum from a storage compartment of a water-traveling vessel or tanker upon damage to a hull of the tanker.

Another, more particular, object of the present invention is based upon the recognition that, given a major hull penetration in a petroleum carrying tanker, there can be no practical way to ensure that no petroleum will spill out of the tanker into the environment. Accordingly, it is an object of the present invention to convert a potentially major environmental disaster, resulting from an accident to a tanker, to a minor spill which can be easily and quickly cleaned up.

Another object of the present invention is to provide such an apparatus, assembly or device which is installable in existing water-traveling vessels or tankers.

Another, more particular, object of the present invention is to provide such an apparatus, assembly or device which is relatively inexpensive and easy to install in existing water-traveling vessels or tankers.

A further particular object of the present invention is to provide such an apparatus, assembly or device which does not displace payload volume and yet is spaced from the walls of a storage compartment in a tanker so as to reduce the damage to the device upon a rupture in the ship's hull.

Yet another particular object of the present invention is to provide such an apparatus, assembly or device which is lightweight and flexible and yet strong and resistant to damage.

Yet another object of the present invention is to provide an associated method for minimizing petroleum spillage into the environment upon damage to a petroleum-carrying tanker on a body of water.

SUMMARY OF THE INVENTION

A device for impeding the flow of liquid cargo from a storage compartment of a water-traveling vessel upon damage to a hull of the vessel the device comprises, in accordance with a first embodiment of the present invention, a barrier member including (a) an upper portion of a flexible sheet material resistant to the liquid cargo and substantially impermeable thereto and (b) a lower portion attached to the upper portion and including a web of fabric material resistant to the liquid cargo and having a predetermined limited degree of permeability thereto. The flow impedance device further comprises reinforcement elements attached to the web for strengthening the fabric material and for at least inhibiting a tear from spreading in the web more than a predetermined distance from a point of perforation of the web. The flow impedance device also comprises support members for supporting the barrier member inside the storage compartment of the water-traveling vessel.

A flow impedance device having a barrier member with an upper impermeable portion and a lower oil-permeable portion, in accordance with the present invention, prevents a petroleum product such as lightweight oil or kerosene from being forced out of the top of the barrier member upon the penetration of water into a lower portion of the barrier member.

Pursuant to another feature of the first embodiment of the present invention, the reinforcement elements include a multiplicity of ribs disposed at a plurality of different angles with respect to each other. Preferably, the ribs are disposed in closed geometric configurations. The most advantageous geometric configurations are triangles. Preferably, the triangular reinforcement ribs have a plurality of different sizes, more preferably exactly two different sizes, wherein triangles of a first size of the two different sizes have a common side length equal to approximately one-half a common side length of triangles of a second size of the two different sizes. Triangles of the first size are in a ratio of four to one with respect to triangles of the second size, and triangles of the second size are each surrounded by six triangles of the first size, two of the triangles of the first size being disposed along each side of a triangle of the second size.

Pursuant to further features of the first embodiment of the present invention, the ribs are made of synthetic resin material partially permeating the fabric material of the web and project from both sides of the web.

The support members includes connectors for attaching the barrier member to an inner surface of the storage compartment of the water-traveling vessel.

Pursuant to another feature of the first embodiment of the present invention, the lower portion of the barrier member is at least partially coextensive with a horizontal bottom wall of the barrier member.

Pursuant to yet another feature of the first embodiment of the present invention, the web is provided with replaceable sections each of a limited degree of permeability to petroleum. The replaceable sections each include a frame and a web of petroleum permeable material fastened to the frame. Preferably, the replaceable sections are triangular in shape.

Pursuant to yet another feature of the first embodiment of the present invention, the support members include bendable elongate resilient members attached to the barrier member. The elongate resilient members are advantageously coextensive with major linear dimensions of the barrier member.

Pursuant to yet another feature of the first embodiment of the present invention, the upper portion of the barrier member extends at least two-thirds the way down from an uppermost wall of the barrier member.

A device for impeding the flow of liquid cargo from a storage compartment of a water-traveling vessel upon damage to a hull of the vessel comprises, in accordance with a second embodiment of the present invention, a barrier member including (a) a sheet of fabric material resistant to the liquid cargo and having a predetermined limited degree of permeability thereto and (b) reinforcement elements attached to the sheet for strengthening the fabric material and for at least inhibiting a tear from spreading in the sheet more than a predetermined distance from a point of perforation of the sheet. The flow impedance device further includes support members in the form of bendable elongate resilient members attached to the barrier member for supporting the barrier member inside the storage compartment of the water-traveling vessel.

A flow impedance device provided with bendable elongate resilient support members in accordance with the present invention is easily inserted into or removed from a storage compartment of a vessel, for replacement or maintenance purposes. The support members automatically open the barrier member upon insertion into a storage compartment and hold the barrier member in an opened configuration floating in the storage compartment upon filling of the compartment with petroleum or other liquid product.

Pursuant to another feature of this second embodiment of the present invention, the resilient members include sections which comprise spring-flex metal elements encased in a petroleum-resistant material.

Pursuant to another feature of the second embodiment of the present invention, the elongate resilient members are coextensive with major linear dimensions of the barrier member.

A device for impeding the flow of liquid cargo from a storage compartment of a water-traveling vessel upon damage to a hull of the vessel comprises, in accordance with another embodiment of the present invention, a barrier member including (a) a web with an opening, (b) a sheet of fabric material resistant to the liquid cargo and having a predetermined limited degree of permeability thereto and (c) releasable connectors for removably securing the sheet to the web to at least temporarily cover the opening. The flow impedance device additionally comprises support members for supporting the barrier member inside the storage compartment of the water-traveling vessel.

Pursuant to another feature of this further embodiment of the present invention, the releasable connectors include (i) a first frame member having a closed geometric configuration, the first frame member being attached to the web to define the opening therein, (ii) a second frame member having a closed configuration substantially the same as the configuration of the first frame member, the sheet being attached to the second frame member to extend over an area defined by the second frame member, and (iii) fasteners for removably securing the second frame member to the first frame member to at least temporarily cover the opening with the sheet. Preferably, the frame members are triangular.

A flow impedance device having a barrier member with removable or replaceable petroleum permeable fabric sections in accordance with the present invention is easily serviced for maintenance, i.e., for cleaning and/or replacing the permeable portions of the barrier member. The permeable portion may be replaced with sections having, for example, a different porosity to adapt the permeability of the barrier member to the specific kinds of petroleum products being shipped in a tanker storage compartment.

Pursuant to another feature of this further embodiment of the present invention, the barrier member further includes reinforcement elements attached to the web for strengthening the fabric material and for at least inhibiting a tear from spreading in the sheet more than a predetermined distance from a point of perforation of the sheet. The reinforcement elements include a multiplicity of ribs disposed at a plurality of different angles with respect to each other in closed geometric configurations, preferably triangles having a plurality of different sizes.

Pursuant to yet another feature of the present invention, the support members include connectors for attaching the barrier member to an inner surface of the storage compartment of the water-traveling vessel.

As described above with respect to the first embodiment of the present invention, an upper portion of the barrier member is preferably essentially impenetratable by petroleum. In that event, the opening is disposed in a lower portion of the barrier member. That lower portion is at least partially coextensive with a horizontal bottom wall of the barrier member, while the upper portion preferably extends at least two-thirds the way down from an uppermost wall of the barrier member.

As discussed above with reference to the second embodiment of the present invention, the support members include bendable elongate resilient members attached to the barrier member. The elongate resilient members are preferably coextensive with major linear dimensions of the barrier member.

A device for impeding the flow of liquid cargo from a storage compartment of a water-traveling vessel upon damage to a hull of the vessel the device comprises, in accordance with yet another embodiment of the present invention, a barrier member including (a) a sheet of fabric material resistant to the liquid cargo and having a predetermined limited degree of permeability thereto, the fabric material including threads of a hydrophilic composition, and (b) reinforcement elements attached to the sheet for strengthening the fabric material and for at least inhibiting a tear from spreading in the sheet more than a predetermined distance from a point of perforation of the sheet. The flow impedance device also comprises support members for supporting the barrier member inside the storage compartment of the water-traveling vessel. The fabric material may also include threads of a petrophilic composition.

A flow impedance device with a barrier member having permeable panels made in part of threads of a hydrophilic composition experiences a valve-type closure action on a microscopic scale which render the fabric material of the barrier member less permeable upon contact with water. This valve action enables the barrier member to freely pass petroleum during periods of normal use while forming a barrier during emergencies wherein water has invaded a storage compartment.

An apparatus, assembly or device in accordance with the present invention recognizes what appears to be an inescapable fact, namely, that whenever extensive damage occurs to the hull of a petroleum bearing ship, some spillage of the payload will occur. Given a major hull penetration of a sea-going tanker and the forces of the sea, no practical economic means can possibly exist to contain 100% of the cargo. In acknowledging that fact, the present invention seeks to minimize the damage by impeding the flow of petroleum out of the damaged vessel. The invention thus serves (1) to buy critical time between the piercing or fracturing of the ship's hull and the arrival of clean-up crews at the disaster site and (2) to contain approximately 93% of the oil in the tanker despite a major hull intrusion of several feet.

A barrier member made of a ribbed fabric web or sheet in accordance with the present invention has a limited permeability to petroleum (or other liquid cargo) and thus floats to some degree in the liquid cargo within a storage compartment of a tanker or other water-traveling vessel or ship. Thus, the compartment may be filled to its outer wall (the hull of the ship, in some cases), thereby maximizing the payload. In addition, because the barrier member is not supporting the payload except in the event of a hull fracture, the barrier member is not fatigued or otherwise subjected to stresses during normal, non-emergency use, which might weaken the barrier member and cause failure thereof in the event of an accident.

In prior proposals for using barrier members in petroleum containing compartments of sea going vessels, the barrier members, in supporting the entire weight of the payload, could increase roll instability of a ship under adverse weather conditions. The instant invention completely eliminates that disadvantageous eventuality.

The reinforcement ribs on the fabric web of a barrier member in accordance with the present invention restrict the damage which is done to the barrier member in an emergency situation. Should the barrier member be pierced or torn, the ribs prevent the spreading of the tear in the fabric material. A tear is limited generally to the longest linear dimension of the geometric shapes in which the ribs are arranged, for example, to the length of the sides of the large triangles in a large and small triangle configuration in accordance with the preferred embodiment of the present invention. The reinforcement ribs offer enhanced resistance to the cutting or abrading action of coral, rocks or other sharp barrier substances which may enter a breached storage compartment with invading sea water upon a collision of a ship with a reef or other underground barrier and which will be moved by wave action in a sawing type motion capable of cutting through a conventional barrier member.

Reinforcing the barrier member material with ribs in geometric configurations such as triangles serves to maximize the strength per unit weight of the barrier member, while preserving the flexibility thereof. The flexibility enables the barrier member to absorb shocks to at least a limited degree and further enables the barrier member to balloon outwardly in the event that the storage compartment is pierced above the water line and the barrier member has to hold the liquid cargo without support of the hull or sea water.

In the case of a shipwrecked or stranded vessel, where a pumping action accelerates the transport of petroleum from a damaged storage compartment into the sea, the instant invention is effective to counteract or withstand the pumping action, particularly by providing a flexible barrier member material which is strong and resistant to tearing and cutting by sharp objects floating in the oscillating sea water, as well as resistant to the interchange of oil and water. In fact, small scale tests of a barrier member material in accordance with the present invention have shown that the porosity of the fabric web or sheet may be selected so as to enable equalization of oil pressure on opposite sides of the fabric web, during normal or non-emergency use of the barrier member material, and to form a barrier between oil on one side of the fabric material and sea water on an opposite side, during emergency use of the barrier member.

DETAILED DESCRIPTION

Figure 1:
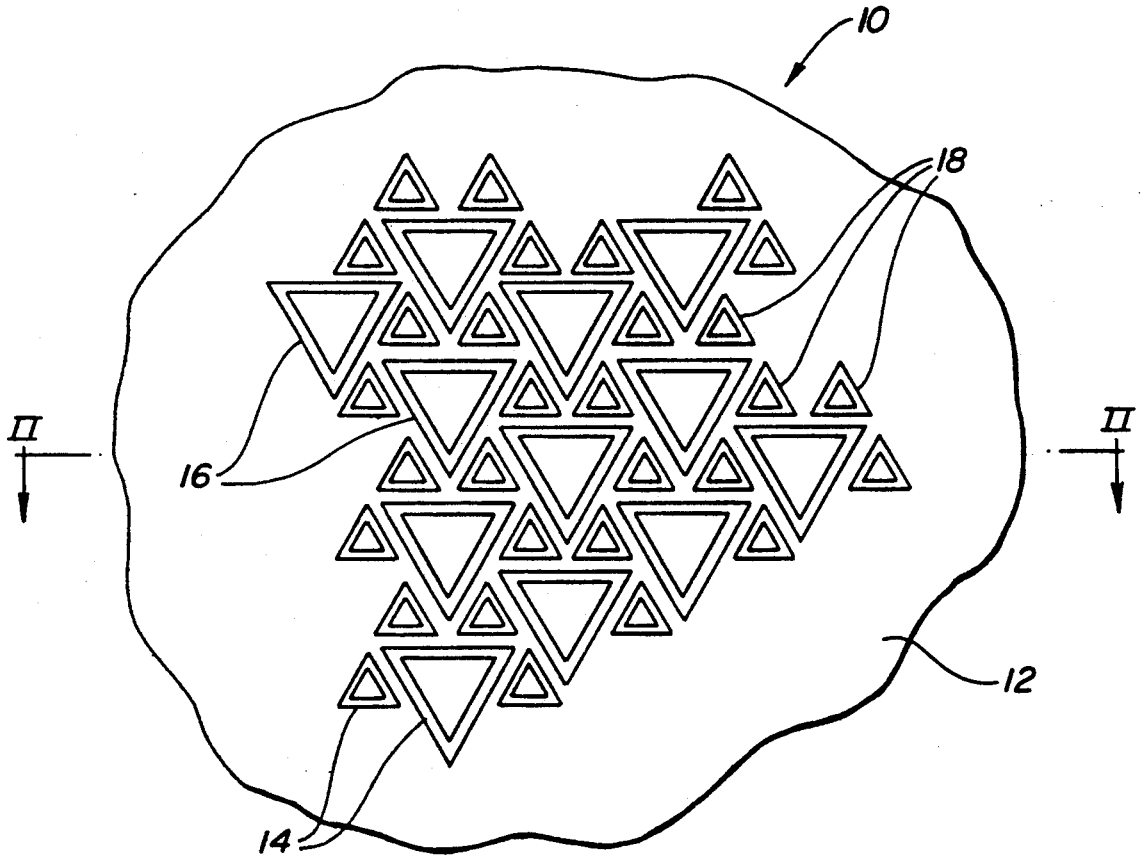
FIG. 1 is a front elevational view of an embodiment of a composite sheet of material, in accordance with the present invention, for lining an oil-bearing compartment of an water-traveling vessel.
Figure 2:
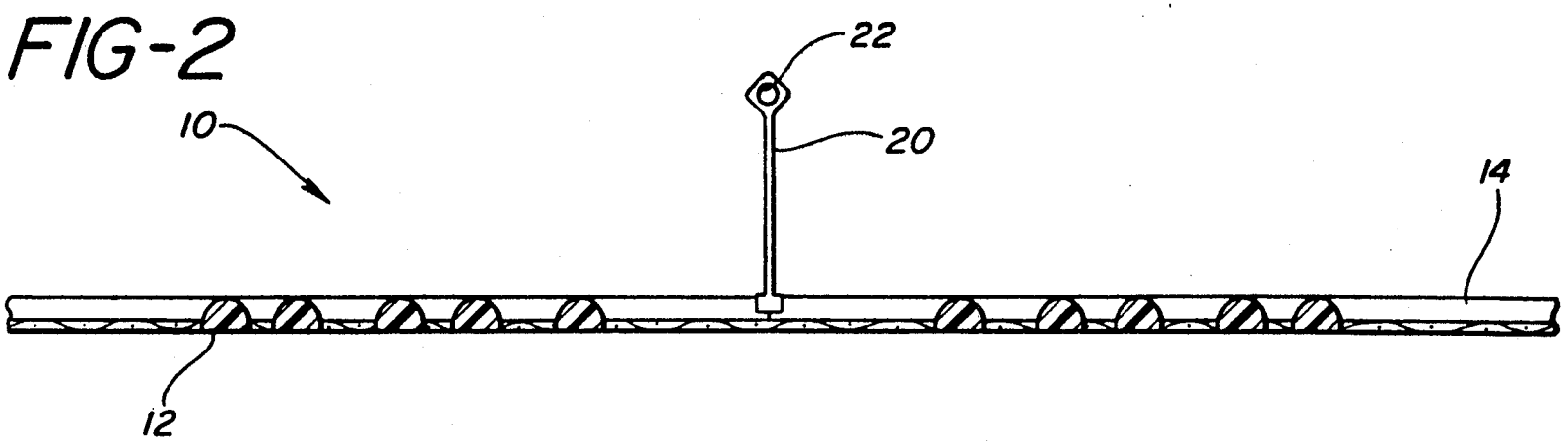
FIG. 2 is a cross-sectional view taken along line II—II in FIG. 1.

As illustrated in FIGS. 1 and 2, a composite barrier member 10 in accordance with the invention may comprise a woven, knitted, nonwoven or other type of fabric web or sheet 12 made of a strong, abrasion- and petroleum-resistant substance such as NOMEX TM. Web 12 is provided on at least one side (FIG. 2) with reinforcement ribs 14 made of a tough, hard, but flexible synthetic resin material such as TEFLON TM, molded nylon, EPDM, rubber-like or reinforced composite material.

Ribs 14 are arranged in an array of closed geometrical or polygonal configurations, preferably in the form of large equilateral triangles 16 and small equilateral triangles 18. Each large triangle 16 is surrounded by six small triangles 18, with two small triangles disposed along each side of the large triangle. Although each large triangle 16 is at the center of six small triangles 18 spaced a short distance therefrom, there are only four times as many small triangles 18 as large triangles 16. Small triangles 18 have a common side length approximately one-half the length of the sides of large triangles 16.

The plastic and/or composite material of reinforcement ribs 14 permeates the fabric material of web 12 in the areas of the ribs so that the web is partially embedded in the plastic material.

Barrier member 10, made of the material shown in FIGS. 1 and 2, is installed in each payload compartment of an oil tanker prior to the filling of the respective compartment with petroleum. As illustrated in FIG. 2, barrier member 10 is provided with a plurality of flexible rods or tethers 20 exemplarily made of an oil-resistant plastic or fiber material for connecting the barrier member to the hull of the tanker and for spacing the barrier member a distance of one to ten feet inwardly from the hull. Each rod or tether 20 may be integrally connected at one end to a semi-flexible reinforcement triangle 16 or 18. At an opposite end, each spacer rod or tether is provided with connection means such as an eyelet 22.

Pursuant to an important feature of the invention, fabric web 12 has a predetermined permeability to petroleum, whereby the barrier member 10 can essentially float in the oil in a tanker compartment and is in a sense a floating liner. The permeability of the barrier member enables an equalization of pressure across the barrier member, thereby minimizing long term stress on the barrier member during periods of normal, non-emergency use. In addition, because the barrier member can float in an oil storage compartment, the entire compartment may be filled with payload, while the barrier member is nevertheless spaced from the walls of the storage compartment and, therefore, from the hull of the tanker. This spacing is also important for purposes of reducing damage to the barrier member upon a piercing of the hull in a collision, inasmuch as forces capable of penetrating a ¾ inch steel plate and ripping therein a hole as large as or larger than twenty feet across would easily pierce a barrier member lying against the steel plate of the hull.

Damage to the barrier member in the event of a collision is also reduced by the tough, but flexible, structure of the barrier member. In most collisions, the barrier member or an outermost wall or panel thereof will give, rather than being breached.

In accordance with another important feature of the invention, reinforcement ribs 14 have an arrangement which prevents the spreading or elongation of a tear or rip made in barrier member 10 upon a grounding of a tanker on a shoal or reef. Reinforcement ribs 14 block any tear from extending a distance greater than the common length of the sides of large triangles 18.

Because barrier member 10 floats within an oil storage compartment at a pre-established distance (determined by the lengths of spacer rods 20) from the hull of a vessel, the barrier member is less subject to damage than a second, inner hull would be upon perforation of the vessel's outer hull, e.g., by a shoal or reef. The floating of the barrier member and its flexibility serve to minimize the damage to the barrier member and in particular to its outermost walls or panels. Moreover, if the barrier member is damaged in a collision or by abrasion against metal shards or sharp edges of a hole in a tanker's hull, the plastic reinforcement ribs minimize the extent of the damage to the barrier member.

The minimization of damage to the barrier member serves to minimize the spillage of oil from a damaged petroleum bearing compartment. However, the invention recognizes that 100% retention of the petroleum payload is practically and economically unfeasible and therefore it surrenders an estimated 2% to 7% of the payload in the breched compartment to the environment.

It is to be noted that the disposition of reinforcement ribs 14 in triangles 16 and 18 is preferred because of the inherent strength of the triangle. However, other geometric shapes are also possible, provided that the arrangement of the shapes prevents the spread of rips or tears in the fabric material of the barrier member. In addition, ribs 14 may have a cross-section other than the semicircular shape shown in FIG. 2. The semicircular cross-section is preferred inasmuch as it is believed to result in stronger and yet more flexible ribs than other possible cross-sections, such as rectangular or polygonal.

Figure 3:
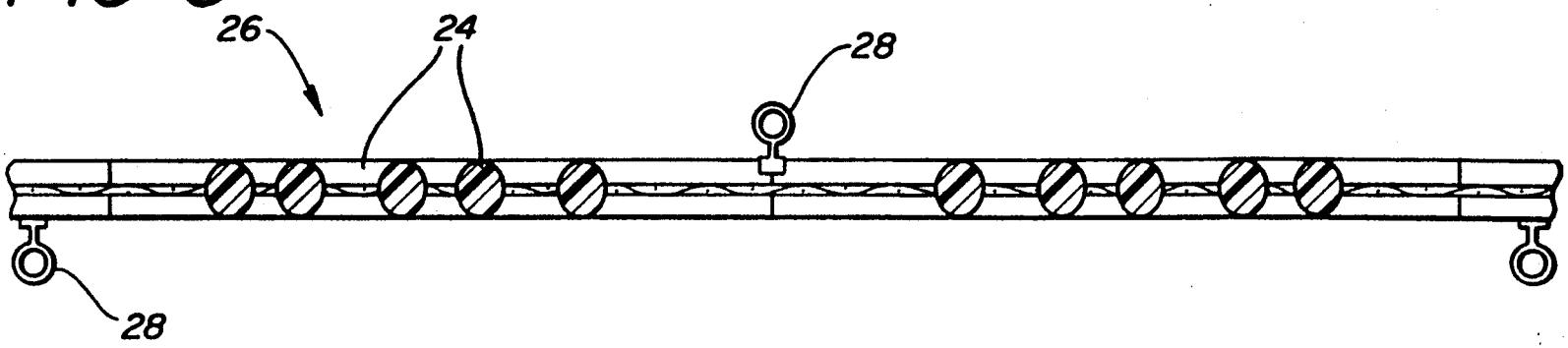
FIG. 3 is a cross-sectional view similar to FIG. 2, illustrating a modified embodiment of a composite sheet of lining material, in accordance with the present invention.

As depicted in FIG. 3, a barrier member 26 may be provided with triangular reinforcement ribs 24 which can project to a limited distance from both sides of the barrier member. In addition, hooks or eyelets 28 or other fastener alternatives may be attached in a regular pattern to the front and back sides of barrier member 26. Eyelets 28 enable anchoring of a front or outer side of barrier member 26 to an inner surface of a vessel's hull and simultaneously enable connection of the back or inner side of barrier member 26 to a second barrier member 30 (FIG. 4) disposed inside the first to provide two layers of protection against the leakage of oil from a damaged vessel. In that case, both barrier members float in petroleum during periods of normal, i.e., non-emergency, use.

It is to be noted that eyelets 28 on the front side of barrier member 26 (FIG. 3) are shifted with respect to the eyelets on the back side of the barrier member so that inner barrier member 30, connected to outer barrier member 26 by flexible spacer rods 32 (FIG. 4), is laterally staggered with respect thereto. The relative staggering of barrier members 26 and 30 strengthens the barrier member assembly inasmuch as the reinforcement ribs on one barrier member may be at least partially criss-crossed with respect to the ribs on the other barrier member.

Figure 4:
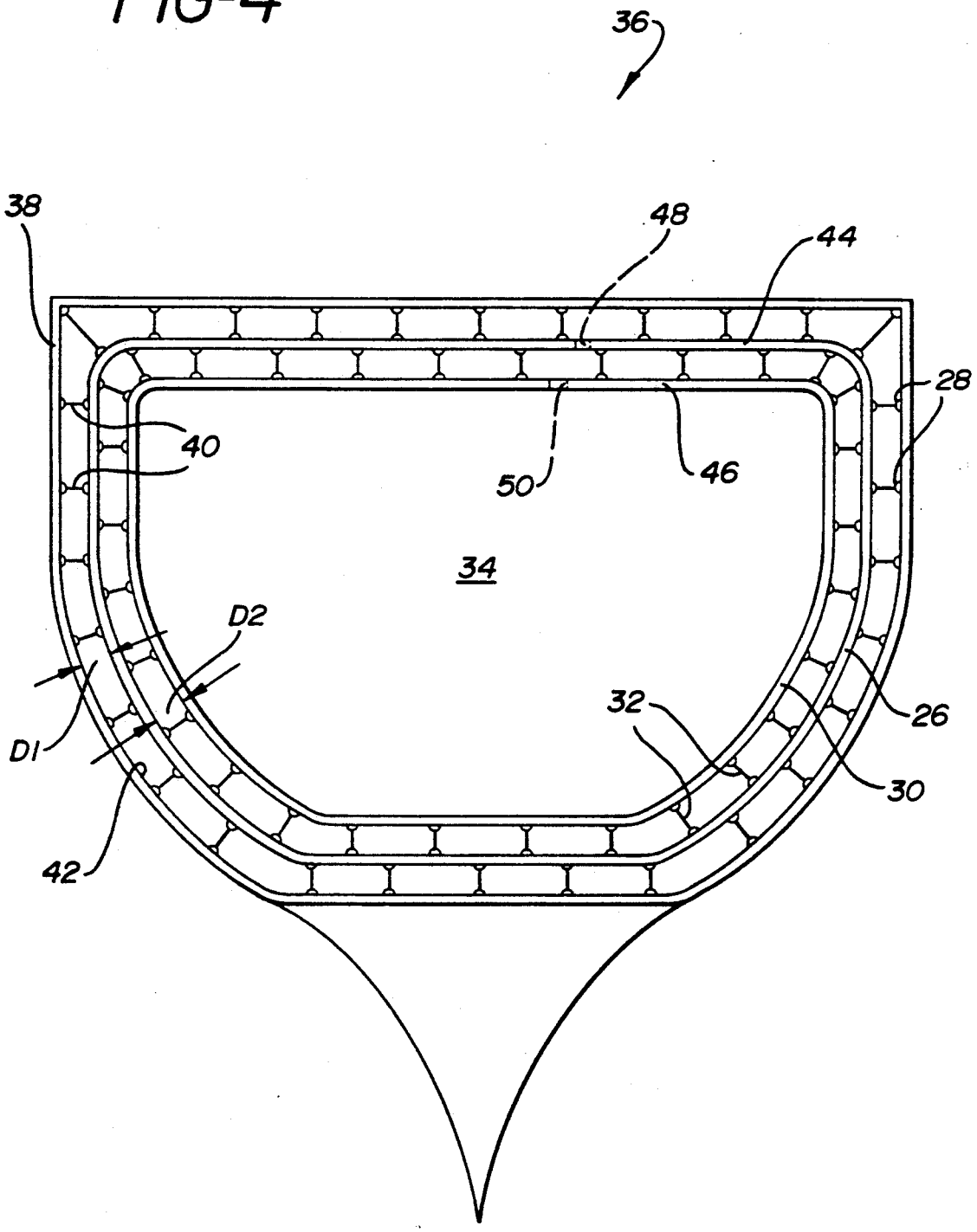
FIG. 4 is a schematic cross-sectional view of a payload compartment of a tanker equipped with a pair of barrier members in a first configuration in accordance with the present invention.

As illustrated in FIG. 4, outer barrier member 26 and inner barrier member 30 each assume the shape of a large bag which substantially conforms to a liquid storage compartment 34 in a sea-going tanker 36. In some cases, as depicted in FIG. 4, the storage compartment may extend the breadth of the tanker 36. In other cases, the hold of the tanker may be subdivided by partitions in both the longitudinal and transverse directions, relative to the tanker's overall dimensions, to form a plurality of large storage compartments. In any case, each separate storage compartment is provided with its own barrier member or plurality of barrier members made of the material described hereinabove with reference to FIGS. 1 and 2 or 3.

In the case depicted in FIG. 4, tanker 36 has a hull 38 which defines in part storage compartment 34. Outer barrier member 26 is thus connected by a plurality of flexible spacer bars or tethers 40 to an inner surface 42 of hull 38 and is spaced by spacer bars 40 a substantially uniform distance D1 inwardly of hull 38. Similarly, inner barrier member 30 may be supported or disposed at a substantially uniform distance D2 from outer barrier member 26 so that upper, lower and side panels of the inner barrier member are substantially parallel to corresponding panels of the outer barrier member.

Barrier members 26 and 30 are advantageously provided along respective upper panels 44 and 46 with openings 48 and 50 for facilitating the introduction of petroleum into the barrier members and also the removal of the petroleum from storage compartment 34.

It is to be understood that the thicknesses of barrier members 26 and 30 have been exaggerated in FIG. 4 for purposes of illustration. In actuality, distances D1 and D2 will generally be between one and ten feet, while ribs 14 and 24 will have thicknesses preferably between ¾ inch and four inches.

Figure 5:
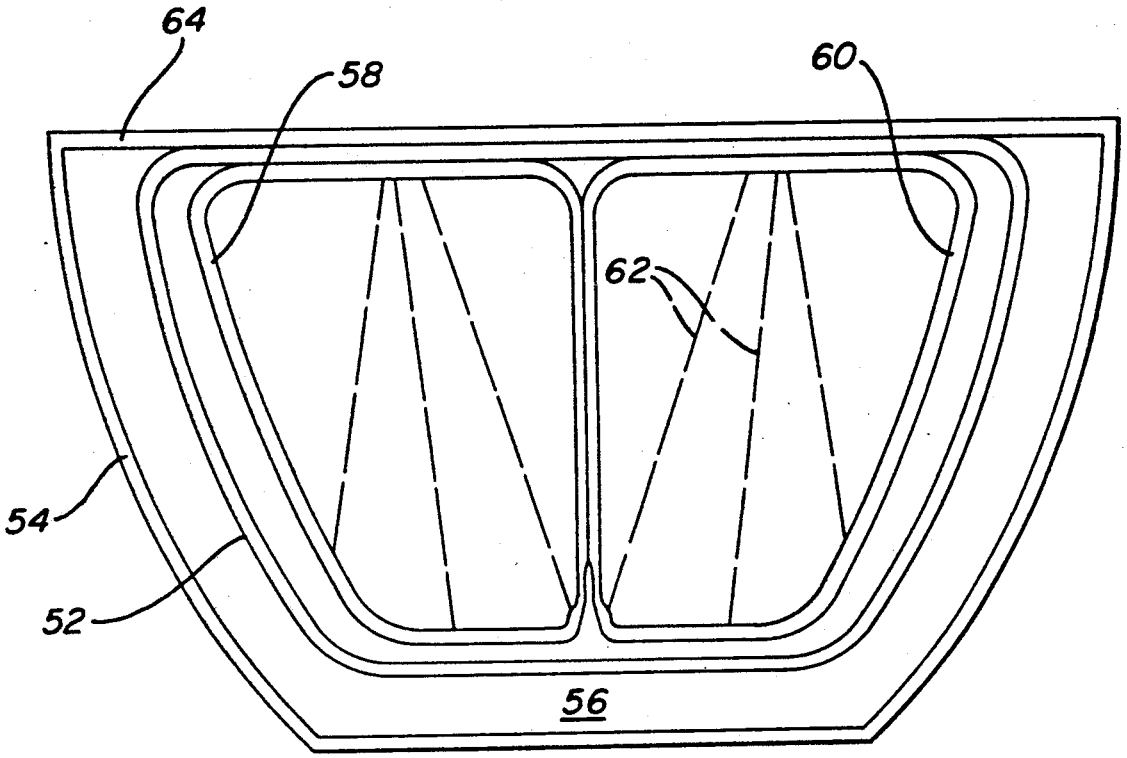
FIG. 5 is a schematic cross-sectional view of a payload compartment of a tanker equipped with a pair of barrier members in a second configuration in accordance with the present invention.

As shown in FIG. 5, an assembly for impeding the flow of liquid cargo from a storage compartment of a water-traveling vessel upon damage to a hull of the vessel may, in accordance with an embodiment of the present invention, comprise an outer barrier member 52 disposed parallel to a wall 54 (e.g., the hull) of a liquid storage compartment 56 of a water-traveling tanker. Provided inside outer barrier member 52 is a plurality of inner barrier members 58 and 60 disposed outside of one another. Barrier members 52, 58 and 60 all have the structure illustrated in FIGS. 1 and 2 or 3, except that eyelets, hooks or other connectors are provided on the barrier members in configurations appropriate to the assembly shown in FIG. 5. As indicated in that drawing figure, tethers or stays 62 may be connected to barrier members 52, 58 and 60 and to an upper wall 64 of compartment 56 for providing supplementary support to the barrier members in the event that petroleum exits from the storage compartment without being replaced by sea water. Tethers, ropes or rods which are installed between outer barrier member 52 and hull 54 for connecting the barrier member to the hull and also for spacing and arranging the barrier member inside storage compartment 56, have been omitted from FIG. 5 for purposes of simplicity. Likewise, additional tethers or other connectors between inner barrier members 58 and 60 and outer barrier member 52 have been omitted.

Figure 6:
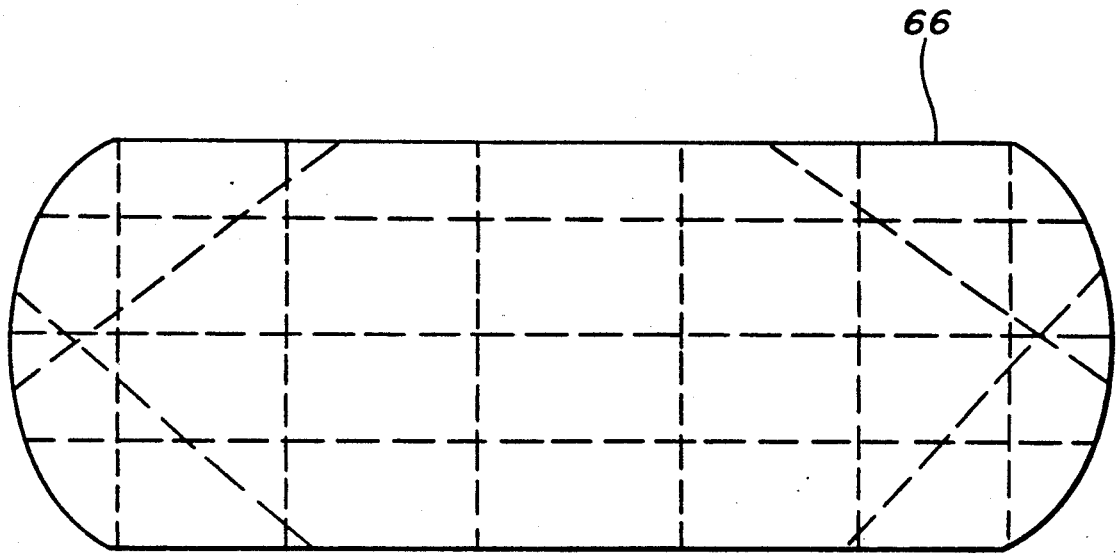
FIG. 6 is a schematic side elevational view of a temporary petroleum storage bag in accordance with the present invention.
Figure 7:
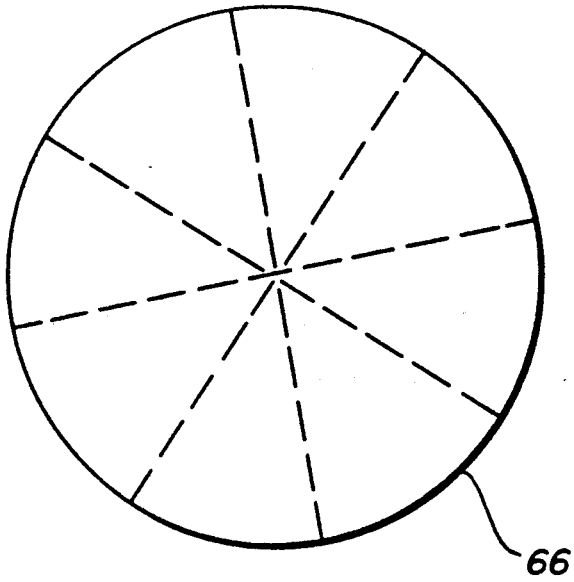
FIG. 7 is an end elevational view of the temporary storage bag of FIG. 6.

As illustrated in FIGS. 6 and 7, the ribbed fabric material of barrier members 10, 26 and 30, may be used in the construction of a foldable temporary storage bag 66 which may be several hundred feet long and half that dimension in width. FIGS. 6 and 7 show the bag in an inflated or expanded condition with structural subunits or sections being indicated by dashed lines. The bag is advantageously provided with a coating or layer of petroleum impermeable material such as a synthetic resin.

Bag 66 is advantageously stored in a folded state on the deck of a petroleum bearing tanker. Upon the occurrence of a collision and resulting damage to the barrier member (or barrier members) inside a storage compartment of the tanker, so that the barrier member is incapable of adequately stemming the outrush of oil, bag 66 is placed onto the water's surface and inflated, either through the application of pneumatic pressure, or through the introduction of petroleum. The oil from the damaged compartment of the tanker is pumped from the damaged compartment into bag 66 and subsequently stored there while the bag is towed to a port or until the liquid can be pumped into another vessel. The bag floats on the surface of the water because its contents, namely, petroleum, are lighter than water. Therefore, only limited auxiliary flotation bladders may be required. An attached automatic radio beacon may be included for ensuring recovery of the bag should it break free of its mooring.

Figure 8:
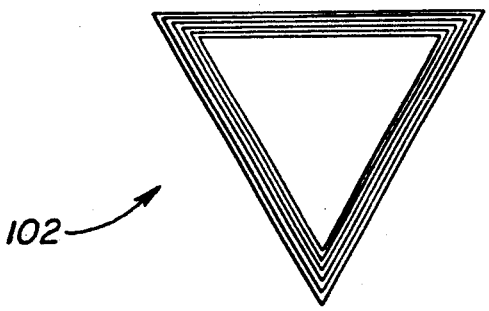
FIG. 8 is an elevational or top view of a particular embodiment of a triangular reinforcement rib on a barrier member sheet, in accordance with the present invention.
Figure 9:
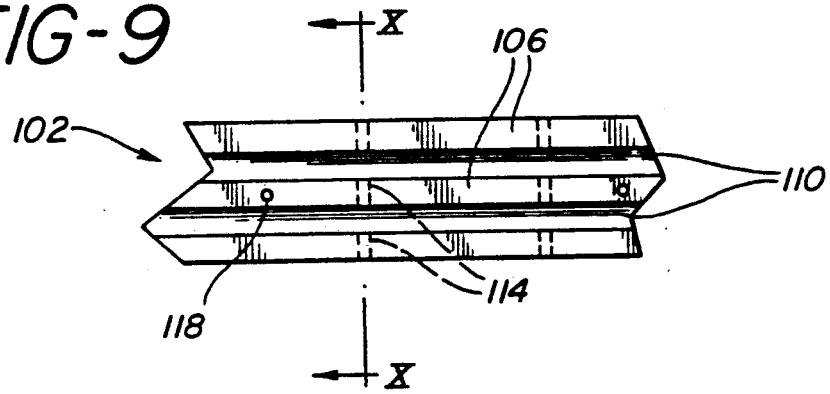
FIG. 9 is an elevational or top view of the triangular reinforcement rib of FIG. 8, on an enlarged scale.
Figure 10:
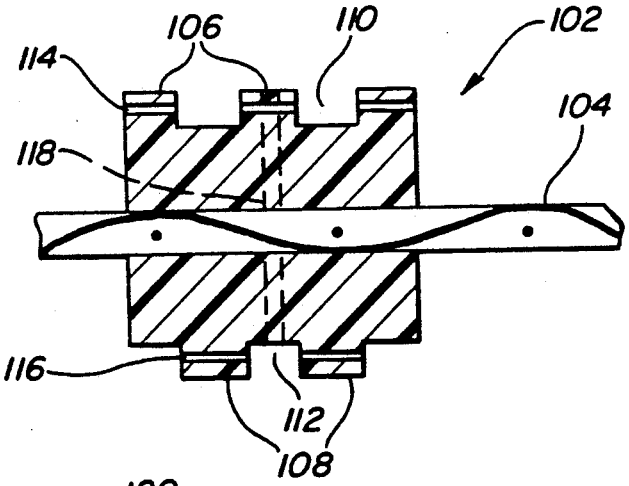
FIG. 10 is a transverse cross-sectional view of the triangular reinforcement rib of FIG. 9 and an underlying fabric web or sheet, on a yet larger scale.

As depicted in FIGS. 8, 9 and 10, a triangular reinforcement rib 102 on a barrier member sheet or web 104 may be provided on each side of the barrier member sheet, in accordance with the present invention, with a series of longitudinally extending beads 106 and 108 defining a plurality of longitudinally extending grooves or recesses 110 and 112. Beads 106 on one side of sheet 104 are transversely staggered with respect to beads 108 on an opposite side of the sheet so that the beads and grooves on one sheet may matingly interlock with the beads and grooves on another sheet to at least temporarily fasten the two sheets together.

As shown in FIGS. 9 and 10, beads 106 and 108 may each be provided with one or more transversely oriented holes 114 and 116 for receiving tethers or other tensile elements (not illustrated) for releasably fastening a barrier member to the inner wall of a petroleum storage compartment of a water-traveling tanker. In addition, triangular reinforcement ribs 102 may be formed with a plurality of bores 118 oriented transversely to sheet 104 for receiving a bolt (not illustrated).

Upon the perforating of a barrier member made of the reinforced sheet material of FIGS. 9 and 10, a sheet of the same material may be attached over the perforation by aligning beads 106 and grooves 110 on the triangular reinforcement ribs of one sheet (e.g., the barrier member sheet) with beads 108 and grooves 112 on the triangular reinforcement ribs on another sheet (the patch sheet). The interlocking beads and grooves serve to temporarily hold the patch sheet to the damaged barrier member until a repair crew can drive connecting bolts (not illustrated) through aligned bores 118 of the two sheets to securely fasten them together.

Figure 11:
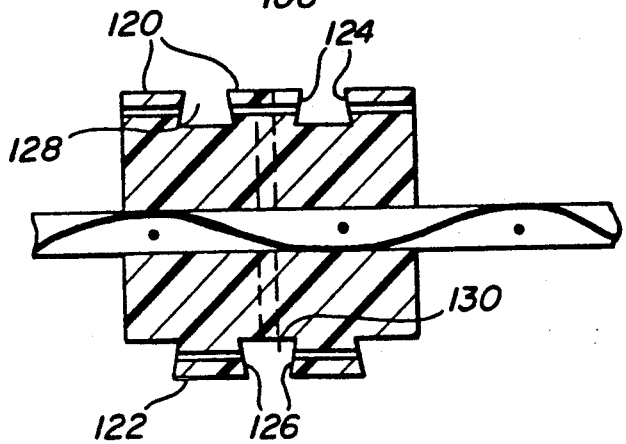
FIG. 11 is a transverse cross-sectional view of another triangular reinforcement rib, pursuant to the present invention.

FIG. 11 shows a modified embodiment of the rib infra-structure illustrated in FIGS. 9 and 10. Beads 120 and 122 may be formed with beveled sidewalls 124 and 126 to form tapered grooves 128 and 130 which are wider at an inner side than an outer side. The groove and bead cross-sections shown in FIG. 11 serve to enhance the gripping capability of those structural features.

Figure 12:
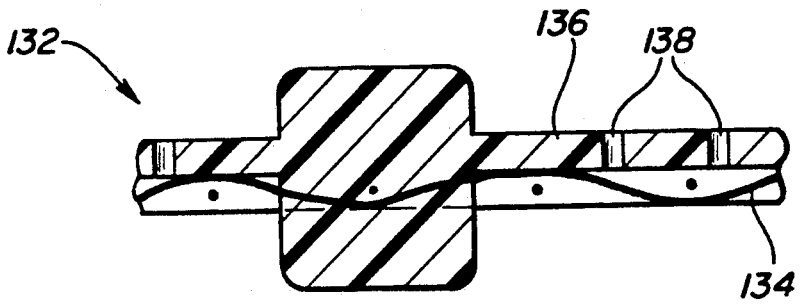
FIG. 12 is a cross-sectional view, similar to FIGS. 2 and 3, showing yet another embodiment of a barrier member sheet in accordance with the present invention.

As depicted in FIG. 12, a barrier member in accordance with the present invention may be formed of a sheet material 132 comprising a fabric web 134 coated on at least one of two sides with a layer !36 of latex or other rubber-like material. The rubbery layer 136 is formed with an array of bores 138 which are precisely engineered, both in their densities and diameters, for controlling the permeability of sheet material 132 to petroleum. The rubber layer serves to enhance the resistance of the sheet material to the shearing action of coral and other sharp objects which may impact against a barrier member upon the occurrence of an accident at sea.

Figure 13:
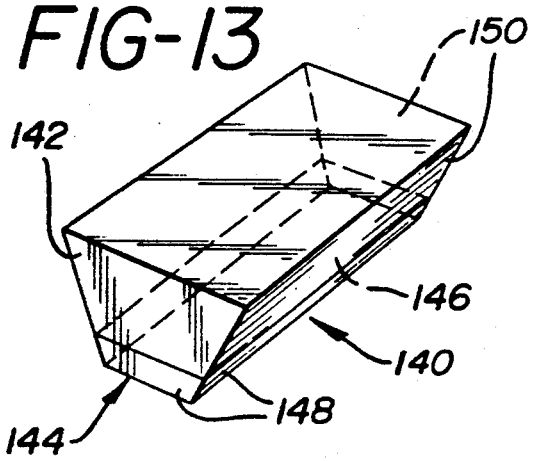
FIG. 13 is a schematic isometric view, taken from an upper side, of a barrier member for a tanker storage compartment in accordance with a particular embodiment of the present invention.

As illustrated in FIG. 13, a barrier member 140 comprises an upper portion 142 made of a flexible sheet material which is not only petroleum resistant but also substantially petroleum impermeable. Upper portion 142 may thus comprise a coated fabric material as described hereinabove with respect to bag 66. The sheet material of upper portion 142 is provided with triangular reinforcement members (not shown in FIG. 13), as described above with reference to FIG. 1. Barrier member 140 also comprises a lower portion 144 made of a fabric sheet which has a predetermined limited permeability to petroleum and which is provided with triangular reinforcement members, as described above with reference to FIG. 1. Lower portion 144 includes a lower wall 146 of barrier member 140, as well as elongate strips 148 at the lower ends of barrier member side walls 150.

Upper portion 142 is particularly effective to prevent petroleum from being forced out through the top of barrier member 140 in the event that an accident leads to water entering barrier member 140 through lower portion 144. Inasmuch as lower portion 144 is permeable to petroleum in accordance with a central principle of the present invention, petroleum is able to enter and fill the barrier member during a loading operation and can be pumped from barrier member 140 during unloading.

Figure 14:
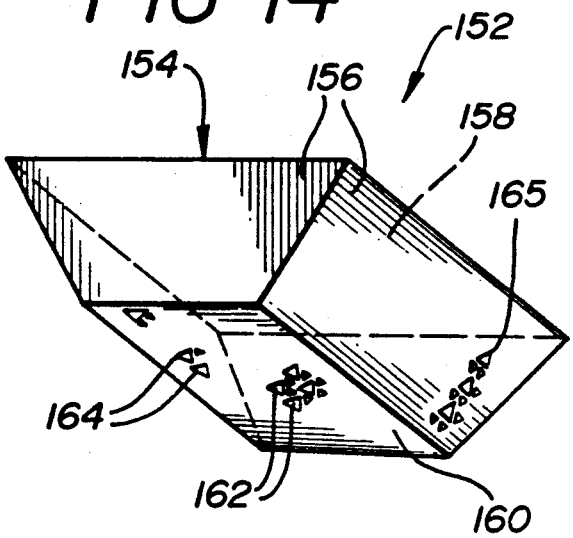
FIG. 14 is a schematic isometric view, taken from a lower side, of a barrier member for a tanker storage compartment in accordance with another particular embodiment of the present invention.

FIG. 14 depicts a barrier member 152 wherein a petroleum impermeable upper portion 154 includes the entire side panels 156, as well as a top panel 158. The only permeable portion of barrier member 152 is the bottom wall or panel 160 thereof. Bottom panel 160 may be comprised in its entirety of reinforced fabric material as described above with reference to FIG. 1. Alternatively, the permeable portions of barrier member 152 may be limited to triangular regions 162 defined by triangular reinforcement ribs 164. Side panels 156, and possibly top panel 158 as well, are formed of a petroleum impermeable material provided with triangular reinforcement ribs 165 as described hereinabove with reference to FIG. 1.

Figure 15:
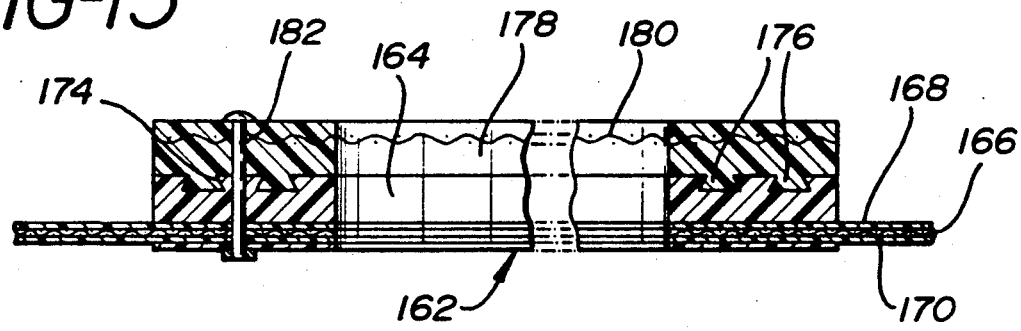
FIG. 15 is a partial cross-sectional view taken through a lower wall of the barrier member shown in FIG. 14.

As shown in FIG. 15, bottom panel 160 takes the form of a web comprising a fabric layer 166 coated on opposite sides by layers 168 and 170 of petroleum impermeable polymeric material. One or more triangular reinforcement ribs or frames 164 define respective triangular openings 162 in bottom panel 160. Each triangular rib or frame 164 is provided in an outer surface with a plurality of tapered longitudinally extending grooves 174 which matingly receive correspondingly tapered longitudinally extending ribs 176 on a triangular frame member 178 surrounding and holding a triangular woven or knitted sheet 180 having a limited permeability to petroleum. Grooves 174 and ribs 176 serve to releasably attach frame member 178 to frame 164. In addition, frame 164 and frame member 178 are provided with alignable bores for receiving a plurality of removable bolts 182 (only one shown in drawing) also serving to fasten frame member 178 to triangular frame 164.

Triangular frame member 178 and sheet 180 together form a modular valve member which has a petroleum permeability determined by the requirements of the application. Frame member 178 may accordingly be replaced by a substantially identical frame member carrying a fabric sheet having a different petroleum permeability. The valve action of modular frame member 178 and sheet 180 is implemented by the type of material used to make sheet 180, as described below.

The fabric material use in any of the embodiments of the invention, including sheet 180 of FIG. 15, is woven, knitted or nonwoven, textile or nontextile. Preferably, the fabric material is woven or knitted and is made of threads of different affinities for water and oil. Threads made of a water absorbent or hydrophilic material such as rayon, a cotton or cotton-like material, or certain acrylates including hydroxyethylacrylate and hydroxymethylmethacrylate alternate with threads made of an oil absorbent or petrophilic material such as textured polyester. Generally, the petrophilic material is hydrophobic. It is to be understood, of course, that the specific materials selected for any particular application must not be resistant to both petroleum and water, that is, non-dissolvable in either liquid.

Upon contacting the hydrophilic fibers or threads, water flowing in through a hole in a damaged vessel or tanker adheres to those threads, while the oil on the other side of the barrier member wall (inside the barrier member) adheres to the petrophilic fibers or threads. The resulting agglomeration of petroleum and water molecules increases surface tension at the fabric web and thereby generates a microscopic barrier which inhibits the penetration of either the water or the petroleum through the fabric material. This valve-like action, instigated by the contact of the water with the fabric material of the permeable sections of the barrier member, is enhanced by absorption of the water molecules into the material of the hydrophilic threads and the consequent dilation of those threads. This dilation results in a secondary valve-like action which serves to reduce the size of the pores or interstices defined by the threads of the fabric. The construction is also very favorable to rapid generation of a thin film of "mousse" that accumulates in the interstices of the fabric and further enhances the valve-like effect virtually sealing all flow.

A barrier member wherein the fabric comprises threads all made of a water absorbent or hydrophilic substance will also be effective in generating a valve-like action to render the fabric web permeable to petroleum and substantially impermeable to water. However, it is desirable in some cases to intersperse among the cotton, rayon or other water absorbing threads fibers which have a greater tensile strength and are made of a water-impervious material.

Figure 16:
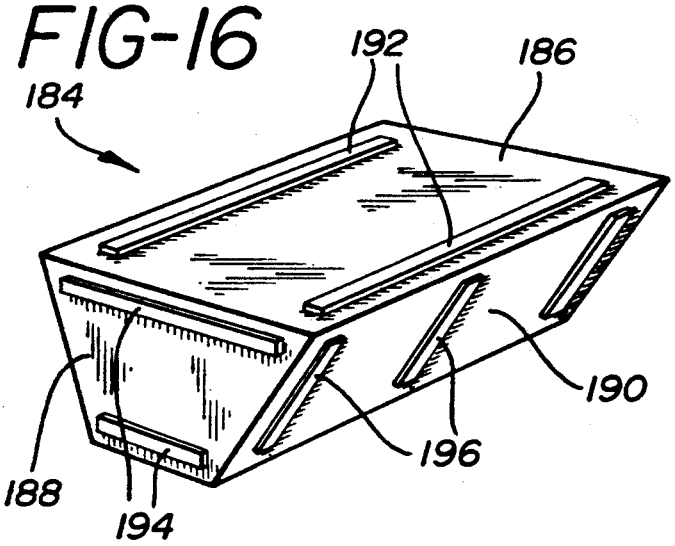
FIG. 16 is a schematic isometric view, taken from an upper side, of a barrier member for a tanker storage compartment in accordance with yet another particular embodiment of the present invention.

As illustrated in FIG. 16, a barrier member 184 is provided on top and side panels 186, 188 and 190, either on the inside or on the outside as illustrated, with respective pluralities of resiliently bendable elongate panel-spreading members 192, 194 and 196 extending along the width or length of the respective panel and connected thereto. Elongate members 192, 194 and 196 serve to spread barrier member 184 from a collapsed or partially collapsed configuration into an opened configuration shown in FIG. 16.

Figure 17:
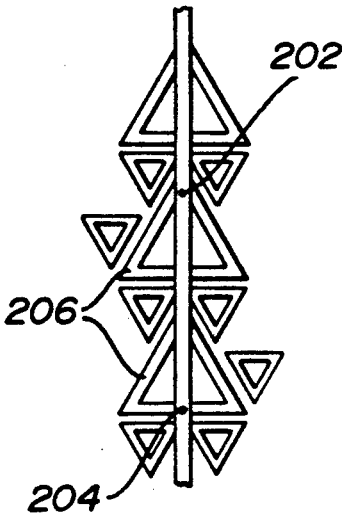
FIG. 17 is a partial plan view of a wall of the liner of FIG. 16.
Figure 18:
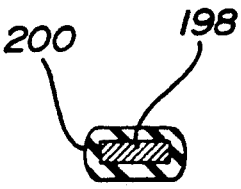
FIG. 18 is a cross-sectional view of a bendable elongate resilient support member of the barrier member of FIG. 16.

Elongate spreading members 192, 194 and 196 specifically take the form of spring-flex metal strips 198, each coated with an enveloping layer of rubber 200 (see FIG. 18). As depicted in FIG. 17 for a spreading member 192, each elongate spreading member 192, 194 and 196 is fastened at spaced points 202, 204 to triangular frame members 206 integrally attached to the respective barrier member panel 186, 188 or 190. Elongate spreading members 192, 194 and 196 have sufficient flexibility to permit barrier member 184 to be bent along arcs which are tight enough to permit barrier member 184 to be removed and inserted inside tanker storage compartment by pulling or pushing the barrier member through an access hatch (not illustrated). Spring-flex spreading members or support strips 192, 194 and 196 flex closed to permit removal and insertion and flex opened to support barrier member 184 in an opened, pertroleum storage configuration.

Although FIG. 16 shows spring-flex elongate spreading members 192, 194 and 196 on three panels 186, 188 and 190 only, it is within the contemplation of the invention that such elongate members are attached along all of the panels of barrier member 184.

The use of spring-flex elongate spreading members 192, 194 and 196 obviates in many circumstances the use of flexible rods or tethers 20 (see FIG. 2). Barrier member 184 accordingly floats freely in a petroleum storage compartment, without the need for attaching the barrier member to the inside walls of the storage compartment. The ease of installation of barrier member 184 also facilitates maintenance insofar as the barrier member may be easily removed and repaired or replaced upon sustaining damage or wear.

Although the invention has been described in terms of particular embodiments and applications, one of ordinary skill in the art, in light of this teaching, can generate additional embodiments and modifications without departing from the spirit of or exceeding the scope of the claimed invention. For example, it is to be noted that the petroleum permeable panels or windows of barrier members or floating liners in accordance with the instant invention may have several layers of fabric material superimposed on one another. Accordingly, it is to be understood that the drawings and descriptions herein are preferred by way of example to facilitate comprehension of the invention and should not be construed to limit the scope thereof.

What is claimed is:

1. A device for impeding the flow of liquid cargo from a storage compartment of a water-traveling vessel upon damage to a hull of said vessel, said device comprising:

a barrier member including:

an upper portion of a flexible sheet material resistant to the liquid cargo and substantially impermeable thereto;

a lower portion attached to said upper portion and including a web of fabric material resistant to the liquid cargo and having a predetermined limited degree of permeability thereto;

reinforcement means attached to said web for strengthening said fabric material and for at least inhibiting a tear from spreading in said web more than a predetermined distance from a point of perforation of said web; and support means for supporting said barrier member inside the storage compartment of the water-traveling vessel.

2. The device defined in claim 1 wherein said reinforcement means includes a multiplicity of ribs disposed at a plurality of different angles with respect to each other.

3. The device defined in claim 2 wherein said ribs are disposed in closed geometric configurations.

4. The device defined in claim 3 wherein said ribs are disposed in triangles.

5. The device defined in claim 4 wherein said triangles have a plurality of different sizes.

6. The device defined in claim 5 wherein said triangles have exactly two different sizes.

7. The device defined in claim 6 wherein triangles of a first size of said two different sizes have a common side length equal to approximately one-half a common side length of triangles of a second size of said two different sizes.

8. The device defined in claim 7 wherein triangles of said first size are in a ratio of four to one with respect to triangles of said second size.

9. The device defined in claim 8 wherein said triangles of said second size are each surrounded by six triangles of said first size, two of said triangles of said first size being disposed along each side of a triangle of said second size.

10. The device defined in claim 4 wherein said ribs are made of synthetic resin material partially permeating the fabric material of said web.

11. The device defined in claim 4 wherein said ribs project from both sides of said web.

12. The device defined in claim 4 wherein said support means includes attachment means for attaching said barrier member to an inner surface of the storage compartment of the water-traveling vessel.

13. The device defined in claim 1 wherein said lower portion is at least partially coextensive with a horizontal bottom wall of said barrier member.

14. The device defined in claim 1 wherein said web is provided with replaceable sections each of a limited degree of permeability to petroleum.

15. The device defined in claim 14 wherein said replaceable sections each include a frame and a web of petroleum permeable material fastened to said frame.

16. The device defined in claim 14 wherein said replaceable sections are triangular in shape.

17. The device defined in claim 1 wherein said support means includes bendable elongate resilient members attached to said barrier member.

18. The device defined in claim 17 wherein said elongate resilient members are coextensive with major linear dimensions of said barrier member.

19. The device defined in claim 1 wherein said upper portion extends at least two-thirds the way down from an uppermost wall of said barrier member.

20. The device defined in claim 1 wherein said web is located in a horizontal bottom wall of said barrier member.

21. The device defined in claim 1 wherein said fabric material is at least partially made of threads of a hydrophilic composition.

22. The device defined in claim 1 wherein said fabric material is at least partially made of threads of a petrophilic composition.

23. A device for impeding the flow of liquid cargo from a storage compartment of a water-traveling vessel upon damage to a hull of said vessel, said device comprising:

a barrier member including:

a sheet of fabric material resistant to the liquid cargo and having a predetermined limited degree of permeability thereto; and reinforcement means attached to said sheet for strengthening said fabric material and for at least inhibiting a tear from spreading in said sheet more than a predetermined distance from a point of perforation of said sheet; and support means including bendable elongate resilient members attached to said barrier member for supporting said barrier member inside the storage compartment of the water-traveling vessel.

24. The device defined in claim 23 wherein said resilient members include sections which comprise spring-flex metal elements encased in a petroleum-resistant material.

25. The device defined in claim 23 wherein said elongate resilient members are coextensive with major linear dimensions of said barrier member.

26. A device for impeding the flow of liquid cargo from a storage compartment of a water-traveling vessel upon damage to a hull of said vessel, said device comprising:

a barrier member including:

a web with an opening;

a sheet of fabric material resistant to the liquid cargo and having a predetermined limited degree of permeability thereto;

releasable attachment means for removably securing said sheet to said web to at least temporarily cover said opening; and support means for supporting said barrier member inside the storage compartment of the water-traveling vessel.

27. The device defined in claim 26 wherein said attachment means includes:

a first frame member having a closed geometric configuration, said first frame member being attached to said web to define said opening therein;

a second frame member having a closed configuration substantially the same as the configuration of said first frame member, said sheet being attached to said second frame member to extend over an area defined by said second frame member; and fastener means for removably securing said second frame member to said first frame member to at least temporarily cover said opening with said sheet.

28. The device defined in claim 27 wherein said frame members are triangular.

29. The device defined in claim 26 wherein said barrier member further includes reinforcement means attached to said web for strengthening said web and for at least inhibiting a tear from spreading in said web more than a predetermined distance from a point of perforation of said web.

30. The device defined in claim 29 wherein said reinforcement means includes a multiplicity of ribs disposed at a plurality of different angles with respect to each other in closed geometric configurations.

31. The device defined in claim 30 wherein said ribs are disposed in triangles.

32. The device defined in claim 31 wherein said triangles have a plurality of different sizes.

33. The device defined in claim 26 wherein said support means includes attachment means for attaching said barrier member to an inner surface of the storage compartment of the water-traveling vessel.

34. The device defined in claim 26 wherein an upper portion of said barrier member is essentially impenetratable by petroleum, said opening being disposed in a lower portion of said barrier member.

35. The device defined in claim 34 wherein said lower portion is at least partially coextensive with a horizontal bottom wall of said barrier member.

36. The device defined in claim 34 wherein said upper portion extends at least two-thirds the way down from an uppermost wall of said barrier member.

37. The device defined in claim 26 wherein said support means includes bendable elongate resilient members attached to said barrier member.

38. The device defined in claim 37 wherein said elongate resilient members are coextensive with major linear dimensions of said barrier member.

39. The device defined in claim 26 wherein said opening is located in a horizontal bottom wall of said barrier member.

40. The device defined in claim 26 wherein said fabric material is at least partially made of threads of a hydrophilic composition.

41. The device defined in claim 26 wherein said fabric material is at least partially made of threads of a petrophilic composition.

42. A device for impeding the flow of liquid cargo from a storage compartment of a water-traveling vessel upon damage to a hull of said vessel, said device comprising:

a barrier member including:

a sheet of fabric material resistant to the liquid cargo and having a predetermined limited degree of permeability thereto, said fabric material including threads of a hydrophilic composition, and reinforcement means attached to said sheet for strengthening said fabric material and for at least inhibiting a tear from spreading in said sheet more than a predetermined distance from a point of perforation of said sheet; and support means for supporting said barrier member inside the storage compartment of the water-traveling vessel.

43. The device defined in claim 42 wherein said fabric material includes threads of a petrophilic composition.

* * * * *